US005145121A

United States Patent [19]

Erkinger

[11] Patent Number: 5,145,121

[45] Date of Patent: Sep. 8, 1992

[54] APPARATUS FOR CRUSHING OR GRINDING OF FIBROUS MATERIAL, IN PARTICULAR DRUM REFINER

[76] Inventor: Werner Erkinger, No. 26 Dominikanergasse, A-8047 Graz, Austria

[ * ] Notice: The portion of the term of this patent subsequent to Jul. 7, 2009 has been disclaimed.

[21] Appl. No.: 660,229

[22] Filed: Feb. 22, 1991

Related U.S. Application Data

[63] Continuation of Ser. No. 420,743, Oct. 12, 1989, abandoned, which is a continuation of Ser. No. 267,038, Nov. 4, 1988, abandoned.

[30] Foreign Application Priority Data

Nov. 5, 1987 [AT] Austria ..... 2923/87

[51] Int. Cl.[5] ..... B02C 19/00

[52] U.S. Cl. ..... 241/248; 241/259.1; 241/261.1

[58] Field of Search ..... 241/37, 101.2, 239, 241/240, 245, 250, 259.1, 261.1, 259.2, 248

[56] References Cited

U.S. PATENT DOCUMENTS 3,952,958 4/1976 Rich ..... 241/259.1 X

FOREIGN PATENT DOCUMENTS 1165396 9/1964 Fed. Rep. of Germany .
7532380 5/1976 France .
8601434 3/1986 PCT Int'l Appl. ..... 241/37
276356 7/1928 United Kingdom ..... 241/243
2083375 8/1981 United Kingdom ..... 241/261.2

*Primary Examiner*—Mark Rosenbaum
*Assistant Examiner*—John M. Husar
*Attorney, Agent, or Firm*—Paul & Paul

[57] ABSTRACT

Apparatus for the crushing or grinding of fibrous material, wet or mixed with water, preferably chips, with an engine-driven horizontally supported rotor having at least two crushing or grinding elements or grinding plates whose surfaces are inclined to the rotor axis of extend approximately normally thereto, and have diameters increasing away from at least one material feed which is directed approximately radially to the rotor axis or approximately tangentially to the rotor or stator, and a housing receiving the rotor having corresponding inner wall and opposing crushing or grinding surface or grinding plates forming grinding gaps inclined to the rotor axis or extending approximately normally thereto and being adjustable between crushing or grinding elements or grinding plates of the rotor as well as corresponding opposing crushing or grinding elements or grinding plates or the like of the interior housing walls. The opposing crushing or grinding elements or grinding plates or the like are arranged or attached on at least two stator rings of which at least one is displaceable in the housing approximately parallel to the rotor axis, the displaceable stator ring being adjustable independently of one another by means of adjusting means acting on its outer jacket and piercing the housing shell.

34 Claims, 5 Drawing Sheets

APPARATUS FOR CRUSHING OR GRINDING OF FIBROUS MATERIAL, IN PARTICULAR DRUM REFINER

This application is a continuation application of Ser. No. 420,743 filed Oct. 12, 1989, now abandoned, which was a continuation application of Ser. No. 267,038, filed Nov. 4, 1988 now abandoned.

The invention relates to an apparatus for the crushing or grinding of fibrous material, in particular fibrous material wet or mixed with water, such as wood chips. More particularly it relates to drum refiners having an engine-driven, horizontally supported rotor comprising at least two crushing elements grinding elements, grinding plates or the like whose surfaces, advantageously constitute rotation surfaces, in particular frustroconical surfaces. These surfaces are either inclined to the rotor axis or extend approximately normally thereto and have diameters increasing in the direction away from the fibrous material feed. The feed is directed approximately radially to the rotor axis or approximately tangentially to the rotor or stator as well as opposed inclination towards the rotor axis. A housing receives the rotor and has a corresponding inner wall(s) with opposing crushing or grinding surface(s) or grinding plates to those of the rotor the gap between the respective crushing or grinding elements or grinding plates being variable or adjustable.

In the currently used disk refiners, a rotating disk equipped with grinding plates is pressed against a second, stationary or rotating disk between which the grinding stock is introduced. The grinding operation requires high contact pressure of the two disks which must be hydraulically applied by means of an appropriately powerful servo cylinder. For adjusting the grinding gap, the contact pressure is changed, whereby one of the two disks is subjected to a minor axial displacement. Due to the small adjustment range under high power, a precise adjustment of the grinding gap is difficult.

These difficulties are not prevented in the partly or wholly conically shaped grinding gaps of disk refiners, either. Several hydraulic adjusting elements located in the pulp area, in addition to the considerable power consumption, necessitate extremely high performance levels of the synchronous running of these adjusting elements in order to prevent clogging.

Conical refiners provided with a single stator carrying a grinding surface are not even satisfactory if the stator is adjustable. This also applies to such refiners if only the rotor carrying the grinding surface is displaceable and the stator is not adjustable.

It is thus the object of the present invention to avoid the arrangement of adjusting elements in the pulp area of the crushing or grinding apparatus, on the one hand, and to achieve a high degree of precision at low adjusting forces and increased adjustment range, on the other hand.

These objects and the elimination of the aforementioned difficulties are achieved according to the invention by providing for the opposing crushing or grinding elements or grinding plates to be disposed or attached on at least two stator rings of which at least one, for instance two, is (are), horizontally displaceable within the housing in a direction approximately parallel to the rotor axis, the displaceable stator ring(s) being adjustable, in the case of at least two displaceable stator rings in particular independently of one another, by means of adjusting means acting on its (their) outer shell and piercing the housing jacket, and by providing for the rotor to be axially displaceably supported, in particular in the case of one only displaceable stator ring.

Such stator rings can be exactly centered and guided; their adjustment can be effected without contacting the pulp area. The invention has a particularly favorable effect if at least two opposing crushing or grinding surfaces or grinding plates with a diameter increasing away from the material feed, conveniently of opposing inclination to the rotor axis, are disposed or attached on, frustroconical, inner surfaces of at least two mutually independently displaceable stator rings. Known apparatus required the use of adjusting elements located within the pulp area. An adjustment of the rotor shaft alone was not sufficient. The invention is particularly useful if displaceable stator rings, in particular stator rings displaceable independently of one another, are disposed in the housing at both sides of one or a plurality of material feed(s), and said material feed(s) are directed approximately radially to the rotor axis or approximately tangentially to the rotor or stator approximately in the center of said housing and the crushing or grinding surfaces or grinding plates or the like extend with a diameter increasing away from the material feed(s) on the shell of a drum-shaped, for instance axially floatingly supported, rotor and correspondingly on the inner wall of the housing, in particular symmetrically, to both sides from the material feed(s) on the rotation surface, in particular frustroconical surface, inclined towards the axis of rotation. The latter surfaces thus form in a manner known per se, an angle open towards the rotor front faces. The rotor conveniently has additional crushing or grinding surfaces or grinding plates or the like extending approximately parallel to the rotor axis between the material feed(s) and said crushing or grinding surfaces or grinding plates of increasing diameters, forming open angles of approximately or almost 90 degrees. In view of the operating conditions thus created, a simple and precise adjustment of the grinding gap is of particular importance. This can be particularly convenient if the mutually independently adjustable stator rings and the crushing or grinding surfaces or the like forming the gap parallel to the axis and the gap inclined towards the axis are arranged symmetrically in respect of the median plane(s) of the radial or tangential material feed(s). The mechanical fine variability or adjustment of the grinding gap provided by this invention has a particularly favorable effect. This is also the case if the crushing or grinding surfaces parallel to the axis are followed by the frustroconical, crushing or grinding surfaces inclined to the axis at an angle of about 5 to 45 degrees, in particular 15 degrees, the inner surfaces of the, mutually independently displaceable, stator ring(s) supporting the opposing crushing or grinding elements or grinding plates or the like being adapted to the extension of said crushing or grinding surfaces or the like, extending approximately parallel thereto. This is also significant if at least some opposing crushing or grinding surfaces or grinding plates parallel to the horizontal rotor axis are supported or attached on the mutually independently adjustable stator ring(s) in addition to the opposing crushing or grinding surfaces or grinding plates or the like inclined to the horizontal rotor axis or arranged normally in relation thereto. Particularly good crushing or grinding effects can be achieved if the frustroconical grinding surfaces are followed by grinding surfaces forming an angle to the rotor axis of nearly or approximately 90 degrees towards the front faces of the rotor. If, such as frequently happens, material which is wet or mixed with water is crushed or ground, it is important that mechanical adjusting means passing tightly through the housing shell act on the outer jacket of the stator ring(s) for displacing the stator ring(s). In this case, it is also possible to obtain a uniform mechanical adjustment of the grinding gap if a plurality of cylindrical bolts evenly distributed over the circumference of the rotor or housing is disposed in the housing shell, tightly rotatable in radial orifices, which bolts engage a bearing on or in the stator ring outer jacket together with an eccentric bolt, the eccentric bolt also being rotatable in this bearing and said cylindrical bolts being connected to rotating means. These eccentric bolts also provide good guidance and centering of the stator ring(s). Even if the inner space of the housing of the refiner or the like is tightly sealed because of steam generation, a reliable mechanical adjustment of the grinding surfaces inclined towards the rotor axis is achievable if outside of the rotor housing the cylindrical bolts, in particular a plurality thereof, are evenly distributed over the circumference of the rotor or the housing and rigidly connected to one each lever which is (are) articulated to at least one control ring(s) or hoop(s) or the like via (a) guide bar(s) and (a) connecting element(s) attached to said ring(s) or hoop(s) enclosing the rotor housing on the outside, arranged concentrically in relation to the rotor housing and supported for instance on rolls. The adjustment can be carried out at any given time if mechanical adjusting means, for instance hydraulic cylinders or the like acting tangentially to the housing shell, act on the outer circumference of the control ring(s) or the hoop(s) on both sides of the housing, at least two control rings or hoops conveniently being separately adjustable if provided.

According to a further development of the invention, if only one displaceable stator ring is used the rotor shaft is supported floatingly, conveniently on both sides, axially displaceable, in a hydrostatic plain bearing, a sealing unit, such as an axial face seal, enclosing the rotor shaft in the bearing housing between said plain bearing(s) and the housing interior receiving the rotor. When using such a floating support of the rotor, the adjustability of one stator ring is normally sufficient, so that the second stator ring can be fixed in the housing. The mobility of the grinding gap adjustment is achieved by the free axial displaceability or floating support of the rotor.

By the aforementioned measures, it is possible to compensate for the differences in the dimension of the grinding gaps caused for instance by uneven thermal expansion of housing and rotor. For the practical execution, it may be convenient if the control ring(s)—viewed from the rotor axis—is (are) passed outside of the pivoting range of the associated levers around the housing.

According to the invention, a uniform and safe mechanical adjustment of the grinding gap, in its conical zone or the like and in the case of grinding gap systems arranged on both sides of the material feed, can be achieved without great effort in production and operation. The rotation of the control ring(s) effects a good adjustment of the grinding gap from the outside without great effort and without interfering in the pulp area in the grinding gap.

A refiner in which a conical trunnion is provided with crushing bars of varying lengths on its periphery and disposed in the conical inner space of a housing is known per se; the inner wall of the housing is provided with corresponding opposing bars so that a constant grinding gap of a width of 1 to 2 mm results. The material feed is effected on one side of the machine in the area of the trunnion shaft. The output of this refiner is unsatisfactory because the material feed is effected only from one side and immediately on the shaft directly into the constant or inadjustable conical grinding gap. A satisfactory defibration and an adequate degree of disintegration cannot be achieved in this way. This also applies similarly to the known refiners. An adjustment of the grinding gap is not provided in this case.

Further to the state of the art belongs a micro-atomizer in which grinding stock is fed via a screw conveyor centrally from the top to hollanders extending parallel to the axis of a separator impeller wheel, the hollanders forming a constant or inadjustable gap arranged parallel to this axis with the housing receiving said impeller wheel and provided with small notches on its inner wall. The grinding stock ground in this parallel gap is borne by an airstream from the outside to the inside from the grinding zone and passes the aforementioned separator impeller wheel. The coarse matter separated in the wheel is returned to the grinding zone. The required air flow is generated by two blower wheels arranged on both sides of the grinder shaft. Aside from the fact that this known embodiment does not provide for conical grinding gaps or the like to be adjacent parallel to the axis, it is not suitable for the processing of chips or other wet fibrous material, not to mention its particularly elaborate construction.

The invention is explained in detail by means of exemplary embodiments under reference to the accompanying drawings in which FIG. 1 shows an axial sectional view of a refiner with a horizontal rotary shaft;

Figure 1:
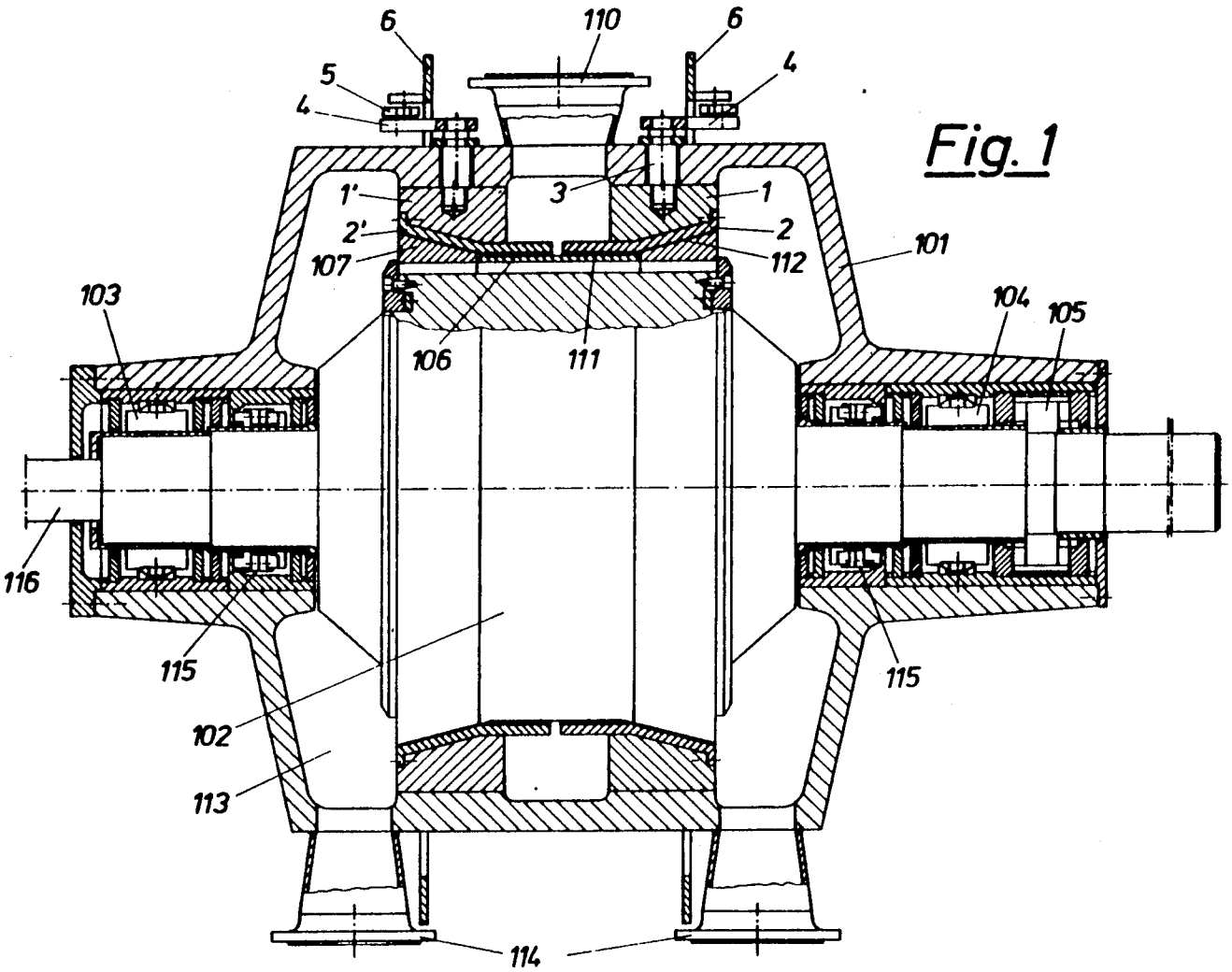

In a preferably horizontally divided refiner housing 101, a cylindrical rotor 102 is supported on both sides in bearings 103, 104 and 105, the bearings, depending on the diameter, capacity and revolutions per minute, being either rolling bearings, sliding bearings or sliding bearings with tilting segments. Attached to the rotor 102 are grinding plates 106 and 107, the grinding plates 106 disposed along a cylindrical shell part serving for precrushing of the chips and the grinding plates 107 enclosing an angle with the rotor axis serving for defibration. By the shape of the grinding plates 107, an inclination of the grinding zone to the horizontal of 5 to 45 degrees, preferably 15 degrees, is obtained.

On two stator rings 1 and 1' horizontally displaceable for adjusting the grinding gap, opposing grinding plates 2 and 2' are attached and cooperate with the grinding plates 107. The axially displaceable stator ring(s) 1 and 1' carrying the grinding plates 2 and 2' are radially engaged by a plurality of eccentric bolts 3 distributed over the periphery and fixing the stator ring(s) 1 and 1' axially as well as radially in the precise desired position. This means that the stator ring(s) 1 and 1' need not be guided along the outer diameter and can thus have clearance in respect of the housing 101.

In order to adjust the grinding gap, the eccentric bolt 3 is rotated via a lever 4 positively connected thereon and a guide rod 5 connected thereto, all the guide rods of a stator ring being exactly and uniformly adjusted by means of a control ring 6 actuated hydraulically or mechanically for instance by the adjusting means 7 to 9.

This (these) control ring(s) 6 is (are) preferably—adapted to the housing—composed of two parts and passed through suitable roll bodies 10 connected to the housing. The control rings 6 are disposed concentrically in relation to the stator ring 1 or 1' and preferably above the pivoting range of the levers 4.

Due to the symmetrical arrangement of the stator rings 1 and 1', the adjusting means is also arranged symmetrically in relation to the center line; the two control rings are adjustable independently of one another in order to compensate for differences in the dimension of the grinding gap on both sides, for instance by unequal thermal expansion of housing and rotor.

The chips are fed radially via 1 to 4 material feed(s) 110 with openings on the periphery of the housing. The chips are precrushed in a horizontal grinding gap 11 and distributed symmetrically in both directions. The defibration of the wood is effected in the adjustable grinding gap 112 inclined towards the horizontal. The grinding stock is conveyed from there to the inner space 113 of the refiner housing 101 and discharged at 114 together with the generated steam.

The bearings are sealed against the steam in the refiner housing by means of sealing units 115.

On the free shaft end 116, an engine, preferably a direct current engine, of essentially lower output than the main engine, can be installed so as to reduce the starting current peak. By this embodiment modified in relation to the known refiners, the refiner according to the invention can be operated with up to 3,600 rpm.

The invention is advantageously applicable to refiners with vertical rotor shafts. The crushing of fibrous materials other than wood and under certain circumstances even leather scraps can be effected without difficulties in this case, water or other liquids possibly being added to the precrushed material.

According to the invention, the following advantages and effects in refiners can be achieved: a guidance and centering of the outer grinding plate support(s) in the form of (a) stator ring(s) by means of radial eccentric bolts distributed over the circumference and a controlled axial displacement of the stator ring(s) by means of eccentric bolts, levers, guiding rods and control ring(s). An additional advantage is a concentric arrangement of the control ring(s) in relation to the stator ring(s), the control rings enclosing the housing: a symmetrical execution of the adjusting means for the two stator rings is most convenient in this respect. The adjustment of one control ring causes the uniform rotation of all the eccentric bolts connected to the same control ring and thus an exact axial displacement of the associated stator ring without jamming or the like. The result is a favorable power-distance-transmission. As a result of the separate control rings for the individual stator rings, a particular control of the grinding gaps, their shape and dimension can be achieved. Complicated hydraulic adjusting means can thus be avoided.

Figure 3:
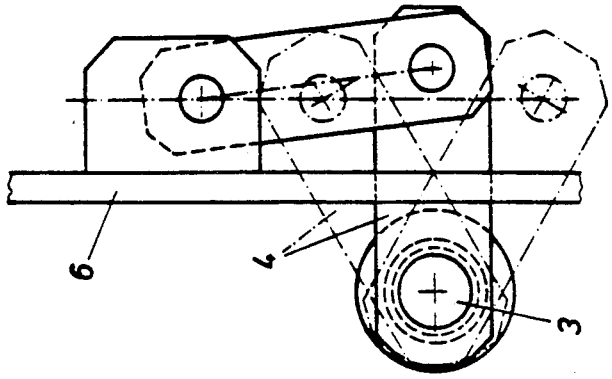
FIG. 3 shows an enlarged detailed plan view of the adjusting system disposed outside of the refiner housing.
Figure 4:
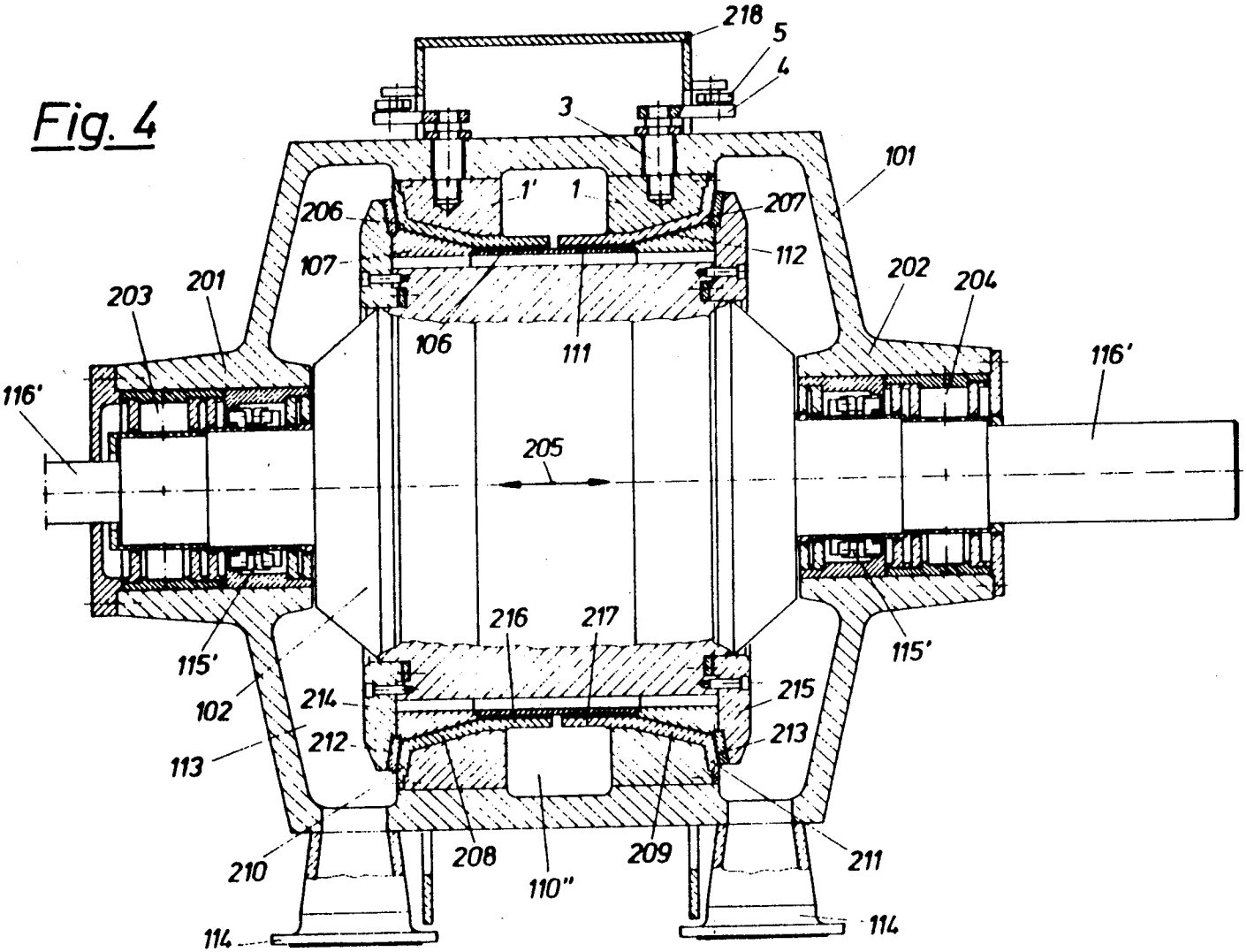
FIG. 4 to 6 represent a further variant in axial sectional view, front view and side view.
Figure 5:
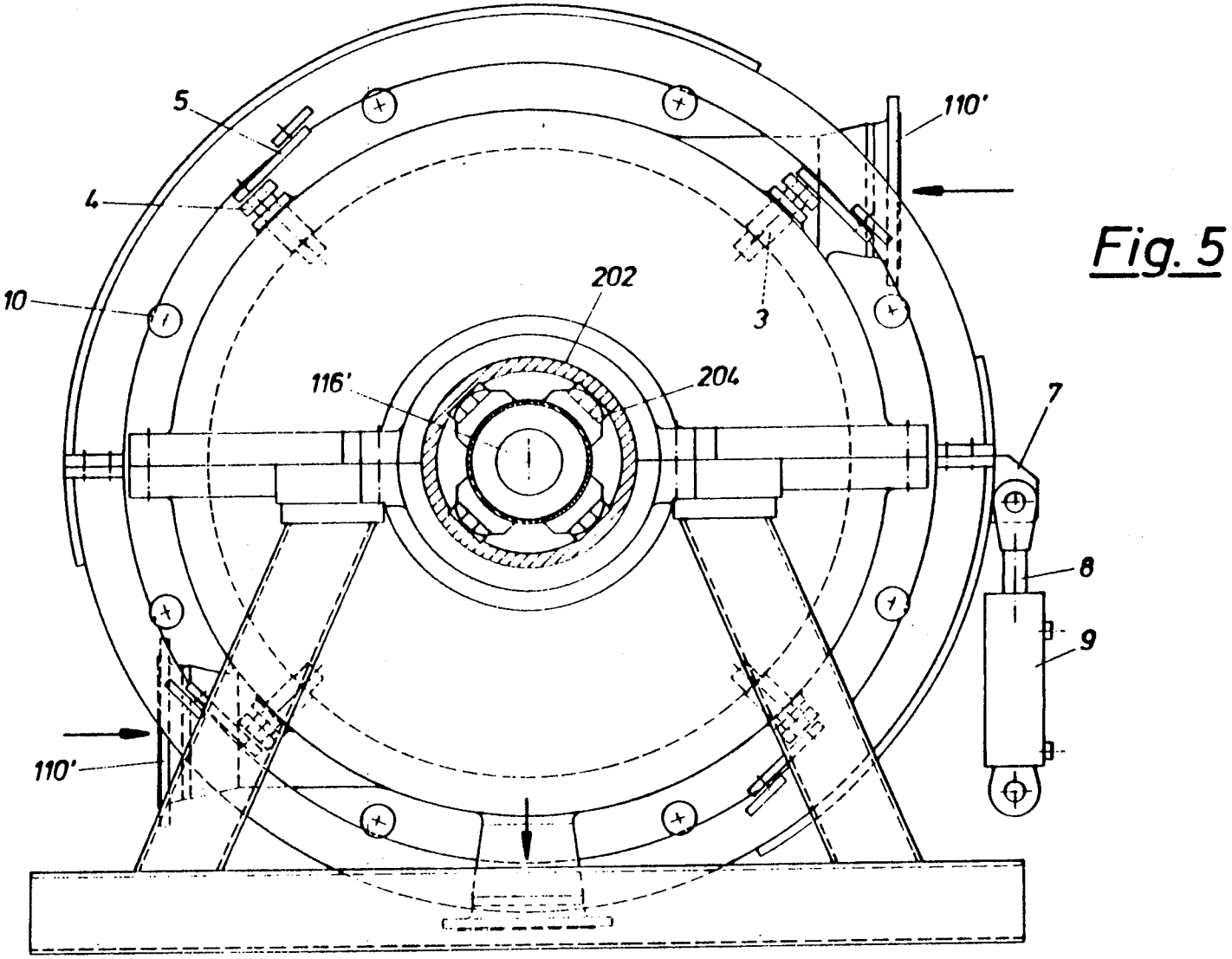
Figure 6:
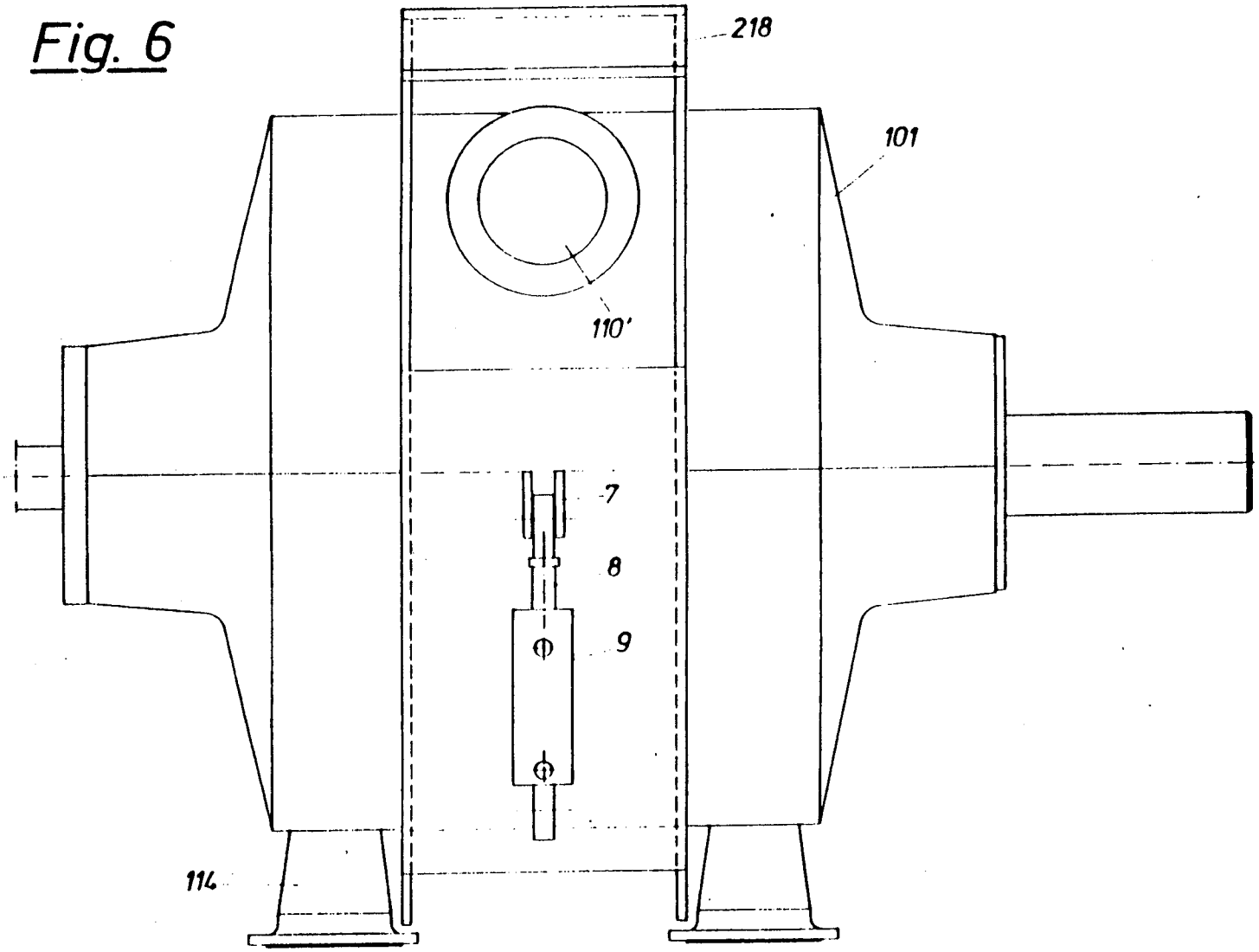

The embodiment according to FIGS. 4 to 6 differs from the one previously described mainly by the type of material feed, the particular support of the rotor and the modified stator adjustment. Corresponding parts are provided with the same reference numbers as those used in FIGS. 1 to 3.

In this embodiment, the material feed is effected at 110' in two places approximately tangentially to the rotor 102 into the annular space 110'' from which the material is then conveyed to the grinding gaps or the like. The shaft ends 116' of the rotor 102 and accordingly the rotor 102 itself are supported floatingly in this case. For this purpose, hydrostatic sliding bearings 203 and 204 are provided in the bearings 201 and 202. The bearings are again sealed against the steam in the refiner housing 101 via sealing units 115'. The double arrow 205 indicates the rotor movement and floating rotor support made possible as previously described. Although the adjustability of only one stator is adequate in this case, as well, the adjustability of both stators 1,1' and accordingly of the grinding plates 206,207 attached to them is also provided for; these grinding plates or the like, in addition to the frustroconical parts 208, 209, have parts 210, 211 enclosing a larger angle, namely of almost 90 degrees, with the rotor axis than the parts 208,209. Additional grinding plates 212, 213 extending just as steeply to the rotor axis as the parts 210, 211 and supported by special rings 214, 215 connected to the rotor 102 cooperate with the parts 210, 211.

Figure 2:
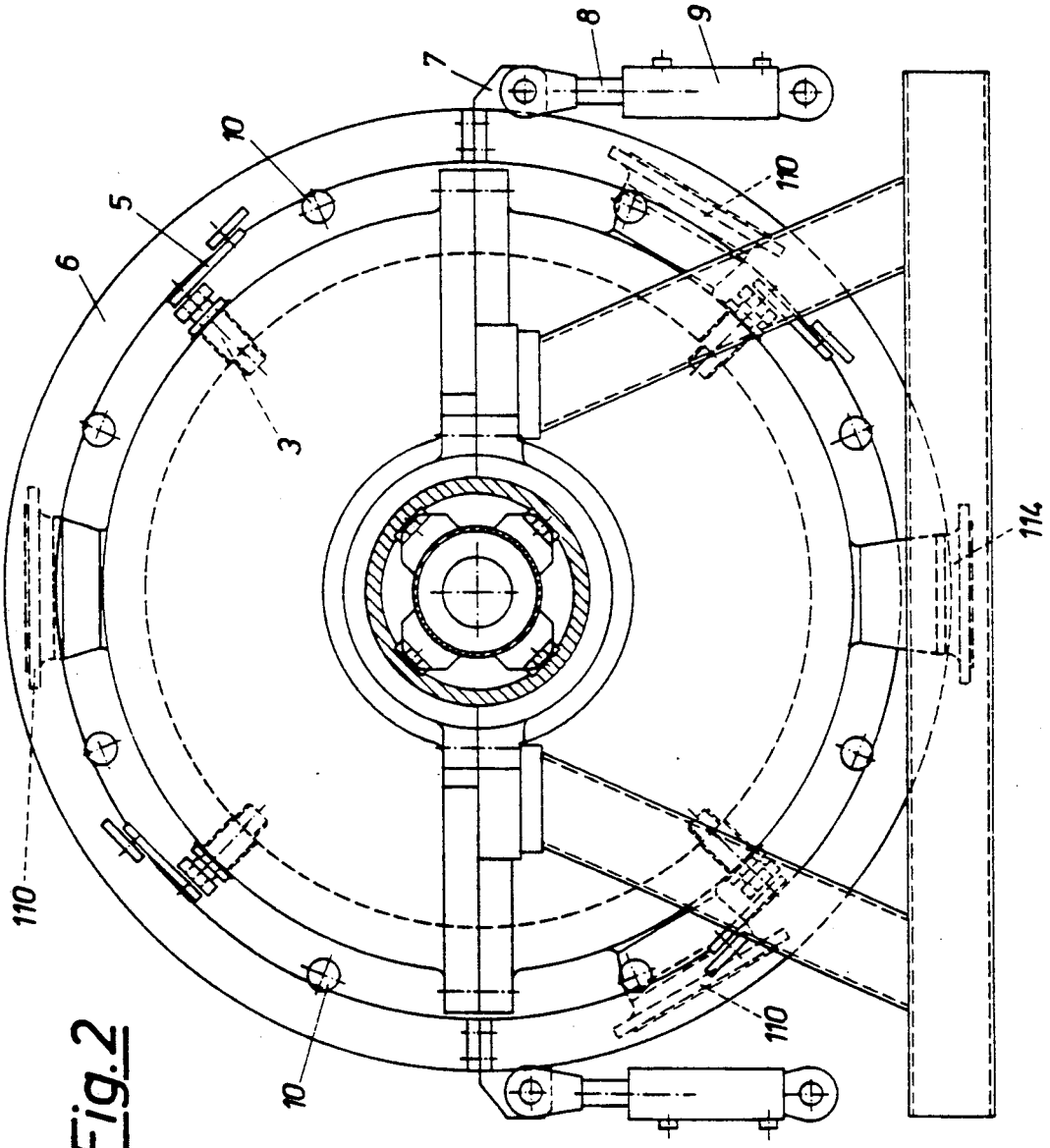
FIG. 2 represents a front view thereof with angularly rotated adjusting means for the stator ring(s)

The adjustment of the stator 1, 1' and thus of the grinding plates or the like 206, 207, 210, 211, but also of the cylindrically formed grinding plates, is effected in a similar manner as shown in FIGS. 1 to 3 via the parts 3 to 5, although in this case simultaneously and in opposite directions via curved hoops 218 which are uniformly displaced by the adjusting means 7 to 9. In view of the floatingly supported rotor, the adjustment of a single stator would be conceivable in this case. The second stator would then be fixedly supported in the housing. The mobility for the grinding gap adjustment is assured by the free axial displaceability (floating support) of the rotor.

I claim:

1. A drum refiner for the grinding of wet fibrous material, said drum refiner comprising material feeds, a drumshaped horizontally supported rotor driven by an engine at high rotational speed of up to 3600 rpm, said rotor having at least two frustoconical rotation surfaces inclined to the rotor axis, the diameters of said inclined frustoconical rotation surfaces increasing in the direction away from said material feeds, said rotation surfaces being provided with grinding elements having grinding surfaces inclined to the rotor axis with the diameters of said grinding elements increasing in the direction away from said material feeds; a housing receiving the rotor, said housing having corresponding inner walls opposing each of said at least two rotation surfaces of said rotor and with opposing grinding surfaces arranged thereon, grinding gaps being formed between said grinding elements of said rotor and said grinding surfaces of said housing, said gaps being inclined to the rotor axis, wherein said grinding elements, said grinding surfaces and said grinding gaps are provided continuously increasing in inclination in both directions away from said feeds and away from the axis of the rotor, said gaps being adjustable between said grinding elements of the rotor as well as said corresponding opposing grinding surfaces of the inner walls of the housing, with a cross-axial plane situated medially of said frustoconical surfaces which are located symmetrically to said plane, said material feeds being inwardly directed in said plane; at least two stator rings being disposed within said housing on each of said inner walls and being located one on each side of and symmetrically to said cross-axial plane and the opposing grinding surfaces being disposed on said at least two stator rings, said stator rings being spaced apart, the material feeds being arranged approximately in the center of said housing, evenly distributed over the circumference of the housing and directed approximately radially to the rotor axis; an annular material feed gap being provided approximately in said cross-axial plane directly between said grinding surfaces of said two stator rings, said material feeds emptying into said feed gap, said feed gap being connected directly to said grinding gaps, and said at least two spaced apart stator rings being displaceable independently of one another within the housing in a direction approximately parallel to the rotor axis and normal to said plane for adjusting the grinding gaps inclined to the rotor axis, the at least two stator rings being adjustable independently of one another by adjusting means acting directly on their peripheries and piercing the inner wall of the housing, said housing being provided with two front walls on both sides of the rotor, with housing cavities and with shaft bearings for the rotor axis being provided in said walls and in said housing cavities into which the grinding gaps immediately empty, said housing cavities being provided in the area of the two housing front walls close to or in the vicinity of the shaft bearings and on both sides of the rotor, said cavities being sealed steam-tight against said two bearings by special sealing units and placed between said rotor and bearings on the side of the rotor and provided with discharge opening for the ground material.

2. The drum refiner according to claim 1, wherein the rotor has front faces and said displaceable stator rings are supported within the housing on both sides of said material feeds directed approximately radially to the rotor axis, said material feeds being provided approximately in the center of said housing, the rotor having drumshaped surfaces provided with said grinding elements on said drumshaped rotor and said grinding surfaces extending on the inner housing walls approximately symmetrically to both sides facing away from said material feeds on the rotation surface inclined towards the rotor axis with a diameter of said rotation surface increasing away from said material feeds, the latter rotation surfaces enclosing an angle with the rotor axis open on both sides toward the front faces of the rotor, grinding gaps being formed between said grinding elements on the rotor and said grinding surfaces on the inner housing walls, said gaps enclosing an angle with the rotor axis open on both sides toward the front faces of the rotor.

3. The drum refiner according to claim 2 wherein precrushing surfaces on the drumshaped rotor and precrushing surfaces extending correspondingly on the inner housing walls, both precrushing surfaces extending approximately parallel to the rotor axis, are provided between the material feeds directed approximately radially to the rotor axis and the grinding surfaces and gaps of increasing diameter and wherein on each side of said material feeds said precrushing surfaces extending on the inner housing walls and extending approximately parallel to the rotor axis and said grinding surfaces extending on the inner housing walls inclined towards the rotor axis are provided on the same displaceable stator rings.

4. The drum refiner according to claim 2, wherein precrushing surfaces on the drumshaped rotor and precrushing surfaces extending correspondingly on the inner housing walls, both precrushing surfaces extending approximately parallel to the rotor axis, are provided between the material feeds directed approximately radially to the rotor axis and the grinding surfaces of increasing diameter, precrushing gaps being formed between said precrushing surfaces extending approximately parallel to the rotor axis on the rotor and on the inner housing walls, said gaps being parallel to said rotor axis and being immediately followed by and merging with said grinding gaps, inclined to the rotor axis.

5. The drum refiner according to claim 2, wherein precrushing surfaces on said drumshaped rotor and precrushing surfaces extending correspondingly on the inner housing walls, both precrushing surfaces extending approximately parallel to the rotor axis, are provided between the material feeds directed approximately radially to the rotor axis and the grinding surfaces and gaps of increasing diameter, precrushing gaps being formed between said precrushing surfaces extending approximately parallel to the rotor axis on the rotor and on the inner housing walls, said gaps being parallel to said rotor axis, said open angles at least partly being approximately angles of 90 degrees.

6. The drum refiner according to claim 1, wherein the rotor has front faces and said frustoconical grinding surfaces and gaps are followed by additional grinding surfaces on said drumshaped rotor and additional grinding surfaces extending correspondingly on the inner housing walls, both additional grinding surfaces enclosing an angle with the rotor axis of approximately 90 degrees, grinding gaps being formed between said grinding surfaces enclosing an angle with the rotor axis of approximately 90 degrees on the rotor and on the inner housing walls, said gaps enclosing an angle with the rotor axis of approximately 90 degrees.

7. The drum refiner according to claim 1, wherein said adjusting means are mechanical adjusting means sealingly passed through the outer shell or periphery of at least one stator ring, said means acting on said outer shell for the displacement of the stator rings, and wherein eccentric bolts are sealingly rotatably supported within the housing and engage with a bearing in the outer shell of the stator ring, the eccentric bolts also being rotatable in this bearing, and said bolts being connected by rotating means, and wherein a plurality of said bolts are evenly distributed over the circumference of the housing and connected to said rotating means, and wherein levers are provided outside of the rotor housing together with at least one control element therefor, and said bolts are connected rigidly to each respective lever, said lever being articulated to said control element enclosing the outside of the housing and arranged concentrically in relation to the rotor axis via a guiding bar and a connecting element attached to said control element.

8. The drum refiner according to claim 1, wherein there is an annular space enclosing the outside of the rotor within the housing, into which space said material feeds empty and wherein said annular material feed gap is provided within said annular space and is connected to said annular space.

9. The drum refiner according to claim 1, wherein the rotor is floatingly supported.

10. The drum refiner according to claim 9, wherein hydrostatic bearings are provided and the rotor is axially displaceably supported in these bearings.

11. The drum refiner according to claim 10, wherein the bearings have housings and sealing units within the bearing housing enclose the rotor shaft between the sliding bearings and the interior of the housing receiving the rotor.

12. The drum refiner according to claim 10, wherein the bearings have housings and sealing units enclose the approximately horizontally supported rotor shaft within the bearing housings between the sliding bearings and the interior of the housing receiving the rotor.

13. A drum refiner for the grinding of wet fibrous material, said drum refiner comprising material feeds; a drumshaped rotor driven by an engine at high rotational speed of up to 3600 rpm and having an approximately horizontally supported rotor axis; said rotor having at least two frustoconical rotation surfaces being located on both sides of the material feeds and inclined to the rotor axis, the diameters of said inclined frustoconical rotation surfaces increasing in the direction away from said material feeds, said rotation surfaces being provided with grinding elements having grinding surfaces inclined to said axis with diameters increasing in the direction away from said material feeds; and with a housing receiving the rotor, said housing having corresponding inner walls opposing each of said at least two rotation surfaces of said rotor and with opposing grinding surfaces arranged thereon, grinding gaps being formed between said grinding elements of said rotor and said grinding surfaces of said housing, said gaps being inclined to the rotor axis, wherein said grinding elements, said grinding surfaces and said grinding gaps are provided continuously increasing in inclination in both directions away from said feeds and away from the axis of the rotor, said gaps being adjustable between said grinding elements of the rotor as well as said corresponding opposing grinding surfaces of the inner walls of the housing, with a cross-axial plane situated medially of said frustoconical surfaces which are located symmetrically to said plane, said material feeds being inwardly directed in said plane; at least two stator rings being disposed within said housing on each said inner walls and being located one on each side of and symmetrically to said cross-axial plane and the opposing grinding surfaces being disposed on said at least two stator rings, said stator rings being spaced apart, the material feeds being arranged approximately in the center of the housing and directed approximately tangentially to said housing, an annular material feed gap being provided approximately in said cross-axial plane directly between said grinding surfaces of said two stator rings, said material feeds emptying into said feed gap, said feed gap being connected directly to said grinding gaps, and said at least two spaced apart stator rings being displaceable independently of one another within the housing in a direction approximately parallel to the rotor axis and normal to said plane for adjusting the grinding gaps inclined to the rotor axis, the at least two stator rings being adjustable independently of one another by adjusting means acting directly on their peripheries and piercing the housing, said housing being provided with two front walls on both sides of the rotor, with housing cavities, and with shaft bearings for the rotor axis being provided in said walls and in said housing cavities into which the grinding gaps immediately empty said housing cavities being provided in the area of the two housing front walls close to or in the vicinity of the shaft bearings and on both sides of the rotor, said cavities being sealed steam-tight against said bearings by special sealing units inserted in the bearing housing and placed between said rotor and bearings on the side of the rotor and provided with discharge openings for the ground material.

14. The drum refiner according to claim 13, wherein there is an annular space enclosing the outside of the rotor within the housing, into which space said material feeds empty and wherein said annular material feed gap is provided within said annular space and is connected to said annular space.

15. The drum refiner according to claim 13, wherein the rotor has front faces and said frustoconical grinding surfaces and gaps are followed by additional grinding surfaces on the drumshaped rotor and additional grinding surfaces extending correspondingly on the inner housing walls, both additional grinding surfaces enclosing an angle with the rotor axis of approximately 90 degrees, grinding gaps being formed between said grinding surfaces enclosing an angle with the rotor axis of approximately 90 degrees on the rotor and on the inner housing walls, said gaps enclosing an angle with the rotor axis of approximately 90 degrees.

16. The drum refiner according to claim 13, wherein said adjusting means are mechanical adjusting means sealingly passed through at least one stator ring, and means for the displacement of the stator rings, and wherein eccentric bolts are sealingly rotatably supported within the housing and engage and with a bearing in the stator ring, the eccentric bolts being connected by rotating means, and wherein a plurality of said bolts are evenly distributed over the circumference of the housing and connected to said rotating means, and wherein levers are provided outside of the rotor housing together with at least one control element therefor, and said bolts are connected rigidly to each respective lever, said lever being articulated to said at least one control element enclosing the outside of the housing and arranged concentrically in relation to the rotor axis via a guiding bar and a connecting element attached to said at least one control element.

17. The drum refiner according to claim 13, wherein the rotor is floatingly supported.

18. The drum refiner according to claim 17, wherein hydrostatic bearings are provided and the rotor is axially displacably supported in these bearings.

19. The drum refiner according to claim 18, wherein the bearings have housings and sealing units within the bearings housing enclose the rotor shaft between the bearings and the interior of the housing receiving the rotor.

20. The drum refiner according to claim 18, wherein the bearings have housings and sealing units enclose the approximately horizontally supported rotor shaft within the bearing housings between the bearings and the interior of the housing receiving the rotor.

21. The drum refiner according to claim 13, wherein the rotor has front faces and said displaceable stator rings are supported within the housing on both sides of said material feeds directed approximately tangentially to the rotor axis, said material feeds being provided approximately in the center of said housing, the rotor having drumshaped surfaces provided with grinding elements on said drumshaped rotor and said drumshaped rotor and said grinding surfaces extending correspondingly on the inner housing walls approximately symmetrically on both sides facing away from said material feeds on the rotation surface inclined towards the rotor axis with a diameter of said rotation surface increasing away from said material feeds, the latter rotation surfaces enclosing an angle with the rotor axis open on both sides toward the front faces of the rotor, grinding gaps being formed between said grinding elements on the rotor and said grinding rotor axis open on both sides toward the front faces of the rotor.

22. The drum refiner according to claim 21, wherein precrushing surfaces on said drumshaped rotor and precrushing surfaces extending correspondingly on the inner housing walls, both precrushing surfaces extending approximately parallel to the rotor axis, are provided between the material feeds directed approximately tangentially to the rotor axis and the grinding surfaces and gaps of increasing diameter, precrushing gaps being formed between said precrushing surfaces extending approximately parallel to the rotor axis on the rotor and on the inner housing walls, said gaps being parallel to said rotor axis and being immediately followed by and merging with said grinding gaps, inclined to the rotor axis.

23. The drum refiner according to claim 21, wherein precrushing surfaces on said drumshaped rotor and precrushing surfaces extending correspondingly on the inner housing walls, both precrushing surfaces extending approximately parallel to the rotor axis, are provided between the material feeds directed approximately tangentially to the rotor axis and the grinding surfaces and gaps of increasing diameter, precrushing gaps being formed between said precrushing surfaces extending approximately parallel to the rotor axis on the rotor and on the inner housing walls, said gaps being parallel to said rotor axis, said open angles at least partly being approximately angles of 90 degrees.

24. The drum refiner according to claim 21, wherein precrushing surfaces on said drumshaped rotor and precrushing surfaces extending correspondingly on the inner housing walls, both precrushing surfaces extending approximately parallel to the rotor axis, are provided between the material feeds directed approximately tangentially to the rotor axis and the grinding surfaces and gaps of increasing diameter and wherein on each side of the material feed said precrushing surfaces extending on the inner housing walls and extending approximately parallel to the rotor axis and said grinding surfaces extending on the inner housing walls inclined towards the rotor axis are provided on the same of said displaceable stator rings.

25. In a drum refiner for the grinding of fibrous material with at least one material feed, and with an engine-driven, approximately horizontally supported rotor having an axis and a shell with at least two frustoconical rotation surfaces inclined to the rotor axis and the diameters of said inclined frustoconical rotation surfaces increasing in the direction away from said material feed, and said rotation surfaces being provided with grinding elements, and with a housing receiving the rotor, said housing having corresponding inner walls with opposing grinding surfaces arranged thereon, grinding gaps being formed between said grinding elements of said rotor shell and said grinding surfaces of said housing, said gaps being inclined to the rotor axis and being adjustable between said grinding elements of the rotor shell as well as said corresponding opposing grinding surfaces of the inner walls of the housing, with a plane situated medially of said frustoconical surfaces, said material feed being inwardly directed in said plane, and that there are at least two stator rings within said housing and that the opposing grinding surfaces are disposed on said at least two stator rings, said stator rings being spaced apart, the improvement comprising that the material feed is directed approximately tangentially to the rotor and that said at least two spaced apart stator rings are displaceable independently of one another within the housing in a direction approximately parallel to the rotor axis and normal to said plane, the at least two stator rings being adjustably independently of one another by adjusting means acting directly on their peripheries and piercing the housing.

26. The drum refiner according to claim 25, wherein the rotor has front faces and said frustoconical grinding surfaces are followed by grinding surfaces enclosing an angle with the rotor axis of approximately 90 degrees.

27. The drum refiner according to claim 25, wherein said adjusting means are mechanical adjusting means sealingly passed through at least one stator ring, and means for the displacement of the stator rings, and wherein eccentric bolts are sealingly rotatably supported within the housing and engage with bearings in the stator ring, the eccentric bolts also being rotatable in these bearings, and said bolts being connected by rotating means, and wherein a plurality of said bolts are evenly distributed over the circumference of the housing and connected to said rotating means, and wherein levers are provided outside of the rotor housing together with at least one control element therefor, and said bolts are connected rigidly to each respective lever, said lever being articulated to said at least one control element enclosing the outside of the housing and arranged concentrically in relation to the rotor axis via a guiding bar and a connecting element attached to said at least one control element.

28. The drum refiner according to claim 25, wherein the rotor is floatingly supported.

29. The drum refiner according to claim 28, wherein hydrostatic bearings are provided and the rotor is axially displaceably supported in these bearings.

30. The drum refiner according to claim 29, wherein the bearings have housings and sealing units within the bearing housings enclose the rotor shaft between the sliding bearings and the interior of the housing receiving the rotor.

31. The drum refiner according to claim 29, wherein the bearings have housings and sealing units enclose the approximately horizontally supported rotor shaft within the bearing housings between the sliding bearings and the interior of the housing receiving the rotor.

32. The drum refiner according to claim 25, wherein the rotor has front faces and said displaceable stator rings are supported within the housing on both sides of at least one material feed directed approximately tangentially to the rotor axis, each material feed being provided approximately in the center of said housing, the rotor having drumshaped surfaces provided with grinding elements on the shell of said drumshaped rotor and said grinding surfaces extending correspondingly on the inner housing walls approximately symmetrically to both sides facing away from said material feed on the rotation surface inclined towards the rotor axis with a diameter of said rotation surface increasing away from said material feed, the latter rotation surfaces enclosing an angle with the rotor axis open on both sides toward the front faces of the rotor.

33. The drum refiner according to claim 32, wherein additional grinding surfaces extending approximately parallel to the rotor axis are provided between the material feed directed approximately tangentially to the rotor axis and the grinding surfaces of increasing diameter.

34. The drum refiner according to claim 32, wherein additional grinding surfaces extending approximately parallel to the rotor axis are provided between the material feed directed approximately tangentially to the rotor axis and the grinding surfaces of increasing diameter, said open angles at least partly being approximately angles of 90 degrees.

* * * * *